US008920291B2

(12) United States Patent
Chen et al.

(10) Patent No.: US 8,920,291 B2
(45) Date of Patent: Dec. 30, 2014

(54) SUPPORTING STRUCTURE FOR TREADMILL

(75) Inventors: Ming-Nan Chen, ChangHua County (TW); Yi-Cheng Li, ChangHua County (TW)

(73) Assignee: Dyaco International Inc., Taipei (TW)

( * ) Notice: Subject to any disclaimer, the term of this patent is extended or adjusted under 35 U.S.C. 154(b) by 357 days.

(21) Appl. No.: 13/494,514

(22) Filed: Jun. 12, 2012

(65) Prior Publication Data

US 2013/0231220 A1 Sep. 5, 2013

(30) Foreign Application Priority Data

Mar. 5, 2012 (TW) ..... 101107366 A

(51) Int. Cl.
*A63B 22/02* (2006.01)

(52) U.S. Cl.
USPC ..... 482/54

(58) Field of Classification Search
USPC ..... 482/54
See application file for complete search history.

(56) References Cited

U.S. PATENT DOCUMENTS

| | | | | |
|---|---|---|---|---|
| 6,979,283 | B2 * | 12/2005 | Pan et al. | 482/54 |
| 7,004,887 | B2 * | 2/2006 | Pan et al. | 482/54 |
| 2006/0252605 | A1 * | 11/2006 | Wang | 482/54 |
| 2008/0182726 | A1 * | 7/2008 | Wu | 482/54 |

FOREIGN PATENT DOCUMENTS

| | | |
|---|---|---|
| TW | 435241 | 5/2001 |
| TW | 578575 | 3/2004 |
| TW | M242233 | 9/2004 |
| TW | M308761 | 4/2007 |
| TW | M365758 | 10/2009 |

* cited by examiner

*Primary Examiner* — Stephen Crow
(74) *Attorney, Agent, or Firm* — Huffman Law Group, PC

(57) ABSTRACT

A supporting structure for a treadmill includes an outer tube, an inner tube and a spring means. The outer tube has an inner wall and a protrusion. The outer tube at where the protrusion exists has an outer-tube internal diameter r. The protrusion and the inner wall are separated by a vertical distance L. The inner tube is telescoped within the outer tube and has a positioning hole. The inner tube at where the positioning hole exists has an inner-tube external diameter R, wherein (R+L) <r. When the inner tube is parallel to the outer tube and the protrusion is aligned with the positioning hole, the spring means enters the protrusion into the positioning hole. When the inner tube is inclined with respect to the outer tube, the protrusion is disengaged from the positioning hole, allowing the inner tube to move within the accommodating space.

5 Claims, 7 Drawing Sheets

SUPPORTING STRUCTURE FOR TREADMILL

BACKGROUND OF THE INVENTION

1. Technical Field

The present invention relates to treadmills, and more particularly, to a supporting structure that is used in a treadmill to connect a treadmill foundation and a treadbase.

2. Description of Related Art

A conventional treadmill comprises a foundation lying on the ground, an upright member carrying an instrument panel and a treadbase, wherein the treadbase is swingable with respect to the foundation, so that a user can upright the treadbase for convenient storage. For allowing such folding operation, the conventional treadmill typically is equipped with a supporting structure that serves to hole the treadbase at its upright position.

In the related prior, Taiwan Patents 435241 and M242233 each provide a supporting structure that includes two tubes telescoped with each other and a manually operable knob for selectively positioning the two tubes with respect to each other. Since such a design requires a user's manual operation of the knob for adjusting the supporting structure in length, when intending to release the treadmill from the upright position, a user has to operate the knob with one hand and support the treadbase with the other hand, so the operation is far from being convenient.

Taiwan Patent No. 578575 has disclosed another supporting structure, wherein two telescoped tubes are selectively positioned with each other by means of pins and holes. Nevertheless, it has the similar disadvantage as manual operation is also required therein. Taiwan Patent No. M365758 adopts the concept of the immediately preceding disclosure, but additionally uses a pedal for a user to pedal and thereby control pins in the supporting structure.

Another prior-art supporting structure as disclosed in Taiwan Patent No. M308761 implements a lever to replace the known combination of a pedal and pins.

While the development of the supporting structure has been led from the two-hand-required operation to the pedal-driven mechanism, the existing devices must have the pedal or any other driver exposed outside the tubes of the supporting structure unless a user can not access the pedal. This causes the existing designs to be not good enough in appearance and complicated to process and assemble.

SUMMARY OF THE INVENTION

The primary objective of the present invention is to provide a structurally simplified supporting structure for a treadmill, wherein the supporting structure can be adjusted by a user's kick on specially designed tubes thereof so as to eliminate the need of any additional pedal member.

For achieving the foregoing and other objectives of the present invention, the supporting structure is used in a treadmill that has a foundation lying on the ground and a treadbase swingable against the foundation. The supporting structure is connected between the foundation and the treadbase with its length variable and fixable at a predetermined length, thereby fixing an included angle between the foundation and the treadbase. The supporting structure includes an outer tube, an inner tube and a spring means. The outer tube has an outer-tube pivotal end, an outer-tube telescoping end, an inner wall defining an accommodating space, and a protrusion fixed to the inner wall and jutting out into the accommodating space. The outer tube at where the protrusion exists has an outer-tube internal diameter r. The protrusion has a free end that is apart from the inner wall by a vertical distance L. The inner tube has an inner-tube pivotal end, an inner-tube telescoping end and a positioning hole for receiving the protrusion. The outer-tube pivotal end and the inner-tube pivotal end are pivotally connected to the foundation and the treadbase, respectively. The inner-tube telescoping end is inserted into the accommodating space from the outer-tube telescoping end. The inner tube at where the positioning hole exists has an inner-tube external diameter R, wherein $(R+L)<r$. The spring means serves to place a resilient prestress on the inner tube toward the protrusion. Thereby, when the inner tube is substantially parallel to the outer tube and the protrusion faces the positioning hole, the spring means pushes the inner tube toward the protrusion, making the protrusion enter the positioning hole, so as to fix the supporting structure at the predetermined length. When the inner tube is inclined with respect to the outer tube, the protrusion is disengaged from the positioning hole, so the inner tube is allowed to slide within the accommodating space and thereby vary the length of the supporting structure.

With the foregoing configuration, a user can simply kick the outer tube (or inner tube) to make the inner and outer tubes inclined with respect to each other, thereby disengaging the protrusion from the positioning hole. At this time, the inner tube can move within the outer tube to vary the length of the supporting structure. In other words, in the present invention, there is no need to have any additional pedal member outside the inner and outer tubes, and all the components underlying the positioning between the inner and outer tubes are located inside either the inner or outer tube. Therefore, the disclosed supporting structure is easy to process and assemble, while the appearance can be neat and less complicated, so the present invention can surely satisfy users' expectation.

BRIEF DESCRIPTION OF THE DRAWINGS

The invention as well as a preferred mode of use, further objectives and advantages thereof will be best understood by reference to the following detailed description of illustrative embodiments when read in conjunction with the accompanying drawings, wherein.

DETAILED DESCRIPTION OF THE INVENTION

The following preferred embodiments are made to clearly exhibit the technical contents, features and effects of the present invention, but not to limit the scope of the present invention.

Figure 1:
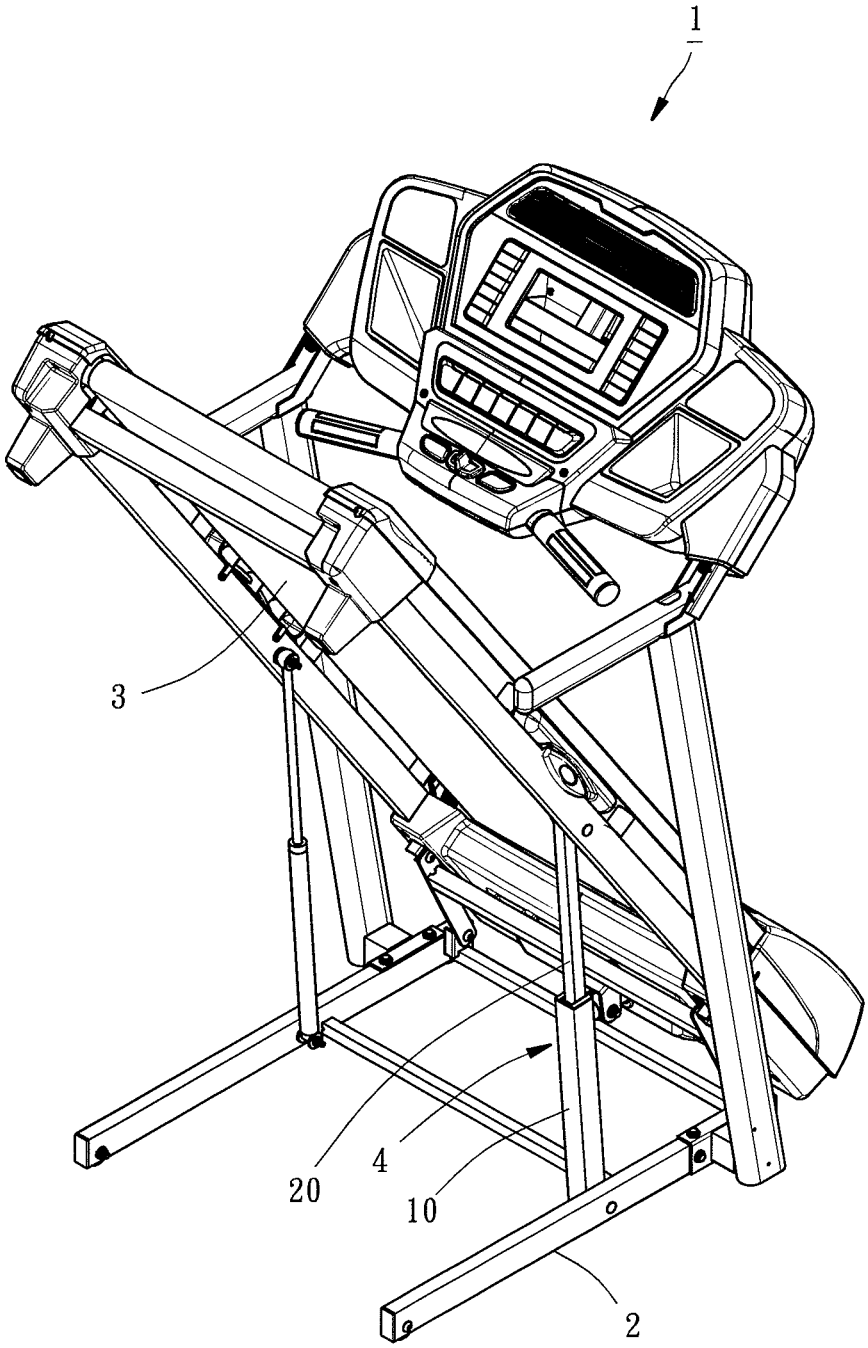
FIG. 1 is a perspective view of a treadmill using a supporting structure according to one preferred embodiment of the present invention.
Figure 2:
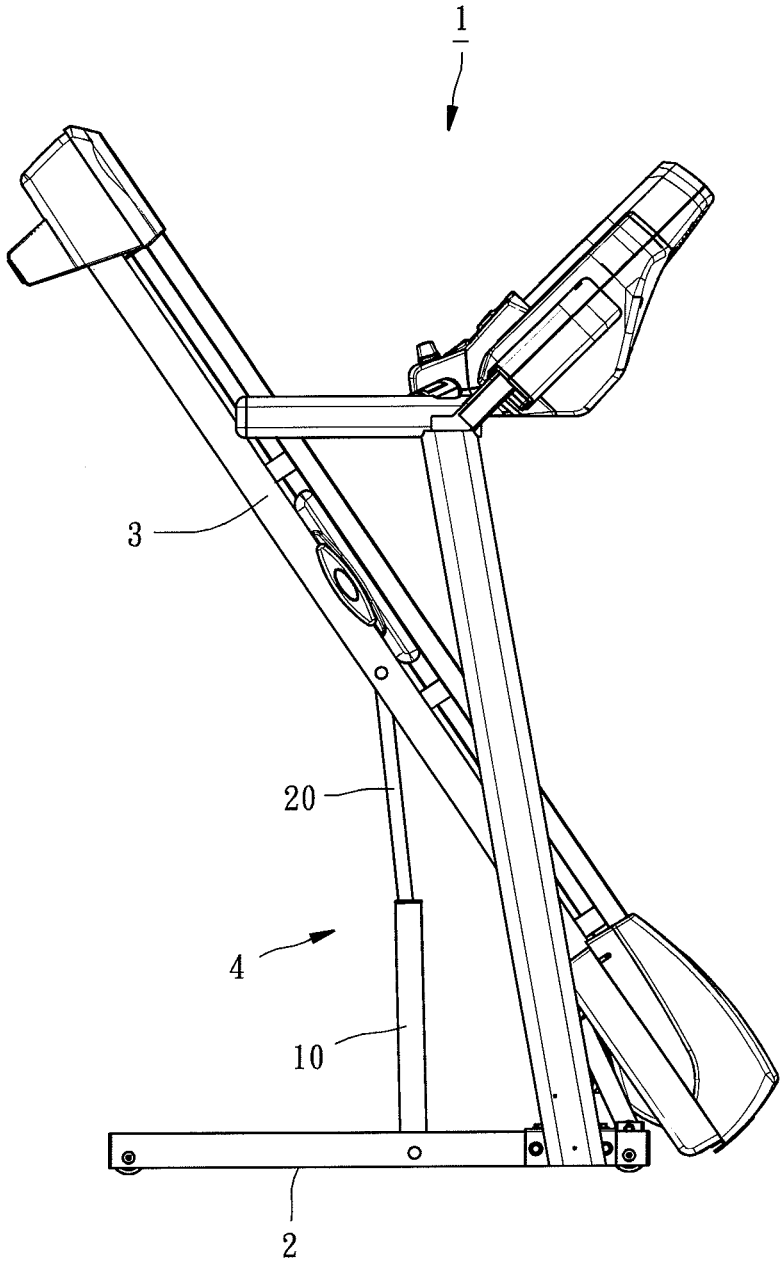
FIG. 2 is a side view of the treadmill of FIG. 1.

Referring to FIGS. 1 and 2, a supporting structure for a treadmill herein disclosed is a supporting structure 4 used in a treadmill 1. The treadmill 1 includes a foundation 2 lying on the ground and a treadbase 3 swingable with respect to the foundation 2. The supporting structure 4 has a variable length and connected between the foundation 2 and the treadbase 3. The supporting structure 4 is selectively fixable at a predetermined length to fix an included angle between the foundation 2 and the treadbase 3. Since the operation and relation of the treadmill 1 and other components are less relevant to the present invention and are known in the art, they need not to be discussed in any length herewith.

Figure 3:
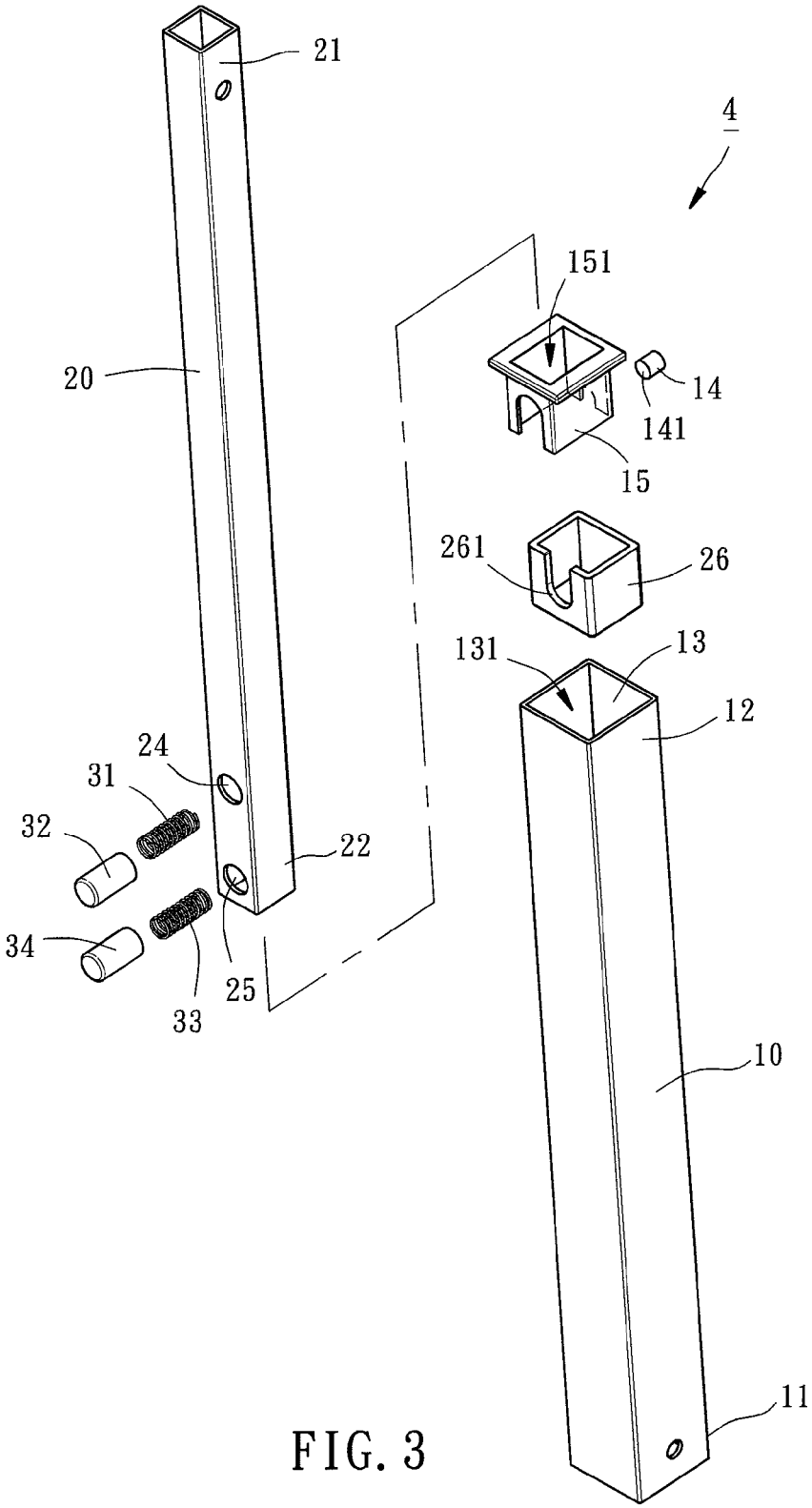
FIG. 3 is an exploded view of the supporting structure according to the preferred embodiment of the present invention.
Figure 4:
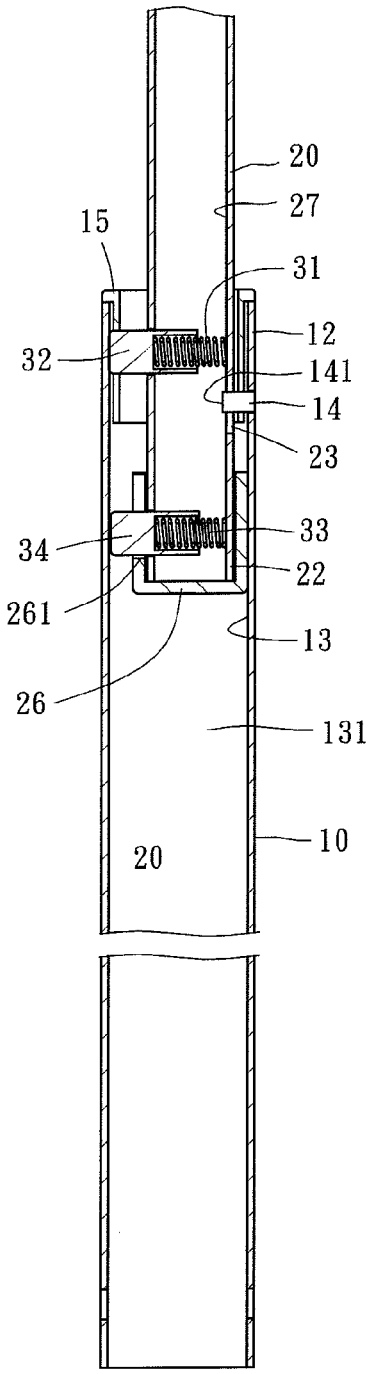
FIG. 4 is a vertical, cross-sectional view of the supporting structure according to the preferred embodiment of the present invention.
Figure 4A:
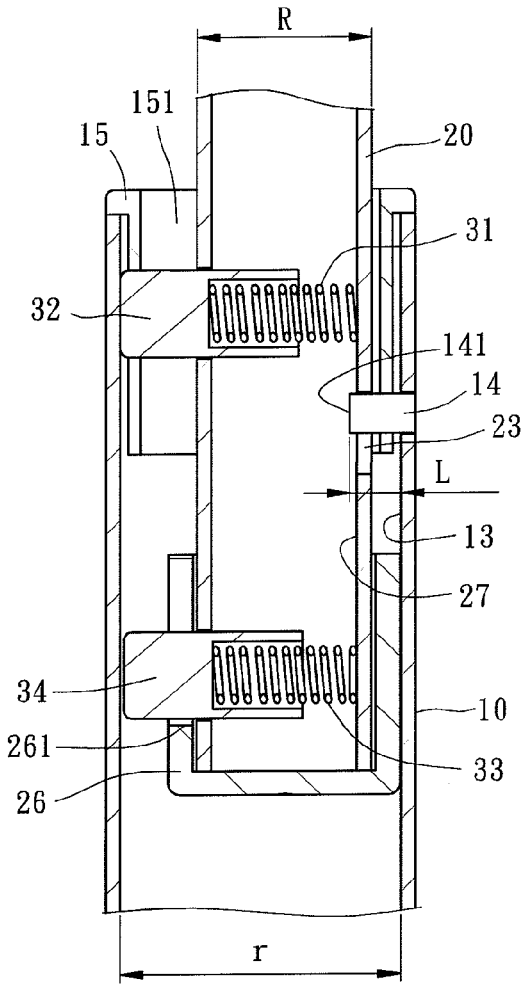
FIG. 4A is a partial, enlarged view of the supporting structure according to the preferred embodiment of the present invention.

Referring to FIGS. 3, 4 and 4A, in the preferred embodiment, the supporting structure 4 comprises an outer tube 10, an inner tube 20 and a spring means.

Figure 5:
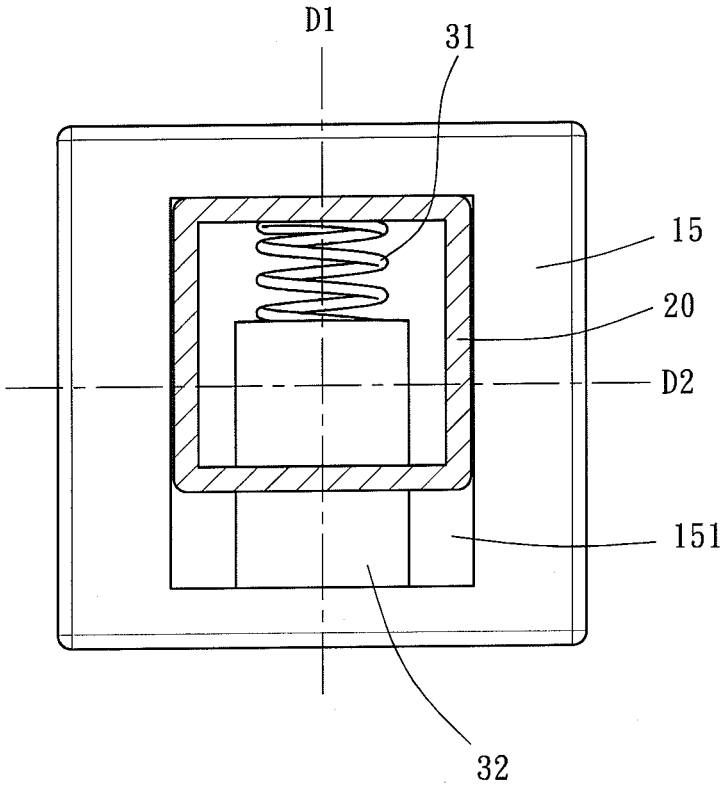
FIG. 5 is a transverse, cross-sectional view of the supporting structure according to the preferred embodiment of the present invention.

The outer tube 10 has an outer-tube pivotal end 11, an outer-tube telescoping end 12, an inner wall 13 defining an accommodating space 131, a protrusion 14 fixed to the inner wall 13 and jutting out into the accommodating space 131 and a shroud 15. The protrusion 14 is fixed to the inner wall 13 in the proximity of the outer-tube telescoping end 12 by means of, for example, screwing, embedding, riveting, soldering, integrating or other known processes satisfying the purpose. The outer tube 10 at where the protrusion 14 exists has an outer-tube internal diameter r. The protrusion 14 includes a free end 141, which is apart from the inner wall 13 by a vertical distance L therebetween. As shown, the outer tube 10 has a square sectional shape, and the outer-tube internal diameter r refers to a distance between one side of the inner wall 13 having the protrusion 14 and an opposite side of the inner wall 13. In other embodiments where the outer tube 10 has a round sectional shape, the outer-tube internal diameter r refers to a diameter of the outer tube 10 at where the protrusion 14 exists. The shroud 15 is received in the outer-tube telescoping end 12 and has a through hole 151 for receiving the inner tube 20. Further referring to FIG. 5, the through hole 151 has a length in a first direction D1 that is greater than an external diameter of the inner tube 20 in the first direction D1. The through hole 151 also has a length in a second direction D2 perpendicular to the first direction D1 that is equal to or slightly greater than the external diameter of the inner tube 20 in the second direction D2. The first direction D1 is parallel to a direction in which the protrusion 14 extends, so that the inner tube 20 is only allowed to incline in the first direction D1. The shroud 15 mainly serves to prevent the inner tube 20 from swaying, and thus may be omitted when the outer tube, the accommodating space and the inner tube are otherwise precisely shaped to have the sway of the inner tube in the second direction limited.

The inner tube 20 has an inner-tube pivotal end 21, an inner-tube telescoping end 22, a positioning hole 23 for receiving the protrusion 14, a first lateral hole 24, a second lateral hole 25 and an end cap 26. The outer-tube pivotal end 11 and the inner-tube pivotal end 21 are pivotally connected to the foundation 2 and the treadbase 3, respectively. The inner-tube telescoping end 22 is configured to be inserted into the accommodating space 131 from the outer-tube telescoping end 12. The inner tube 20 at where the positioning hole 23 exists has an inner-tube external diameter R, wherein (R+L) <r. Thereby, the outer tube 10 provides the inner tube 20 with a sufficient space to incline so as to disengage the protrusion 14 from the positioning hole 23. The end cap 26 is attached to the inner-tube telescoping end 22 and has a notch 261. The end cap 26 is preferably made of a material that is wear-resisting and has a relatively small friction coefficient, so as to prevent that the inner-tube telescoping end 22 otherwise directly rubs against the inner wall 13 of the outer tube 10 and moves unsmoothly. When worn out after long-term use, the end cap 26 can be easily replaced. However, it is to be noted that the end cap 26 is not necessary for the functions of the inner and outer tubes 10, 20 in the present invention.

The spring means serves to place a resilient prestress on the inner tube 20 toward the protrusion 14. In the present embodiment, the spring means is composed of a first spring member 31, a first crown 32, a second spring member 33 and a second crown 34. The first and second crowns 32, 34 are assembled to the first and second lateral holes 24, 25, respectively. The second crown 34 further extends into the notch 261 of the end cap 26. The first and second spring members 31, 33 bias between the first and second crowns 32, 34 and the inner-tube inner wall 27, respectively, for selectively propping the first and second crowns 32, 34 outward the first and second lateral holes 24, 25 to abut against the inner wall 13 of the outer tube 10.

As shown in FIG. 4, when the inner tube 20 is substantially parallel to the outer tube 10 and the protrusion 14 faces the positioning hole 23, the spring means pushes the inner tube 30 toward the protrusion 14, so as to make the protrusion 14 enter and get engaged with the positioning hole 23, thereby fixing the supporting structure 4 at the predetermined length.

Figure 6:
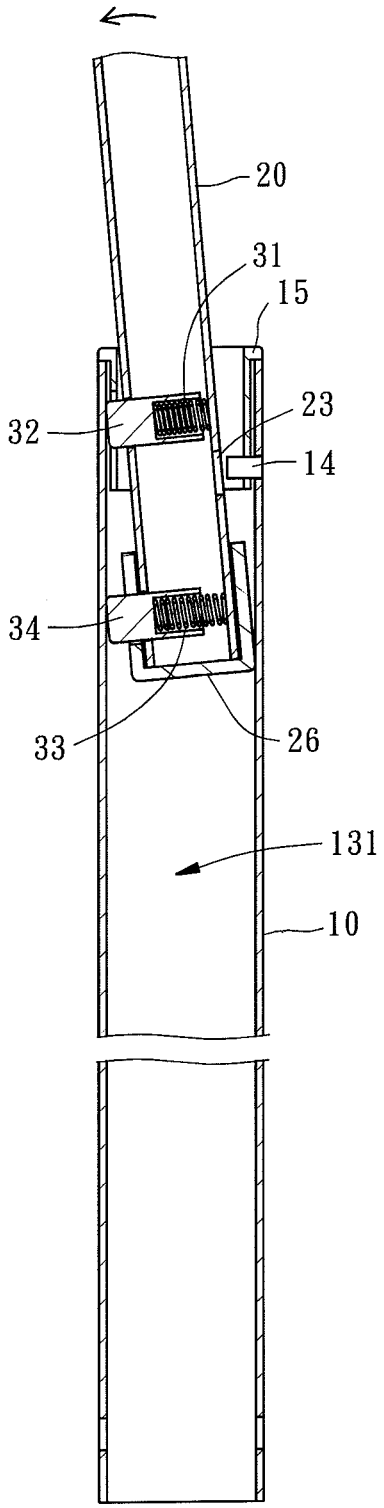
FIGS. 6 and 7 are vertical, cross-sectional views of the supporting structure according to the preferred embodiment of the present invention showing operation of the supporting structure.
Figure 7:
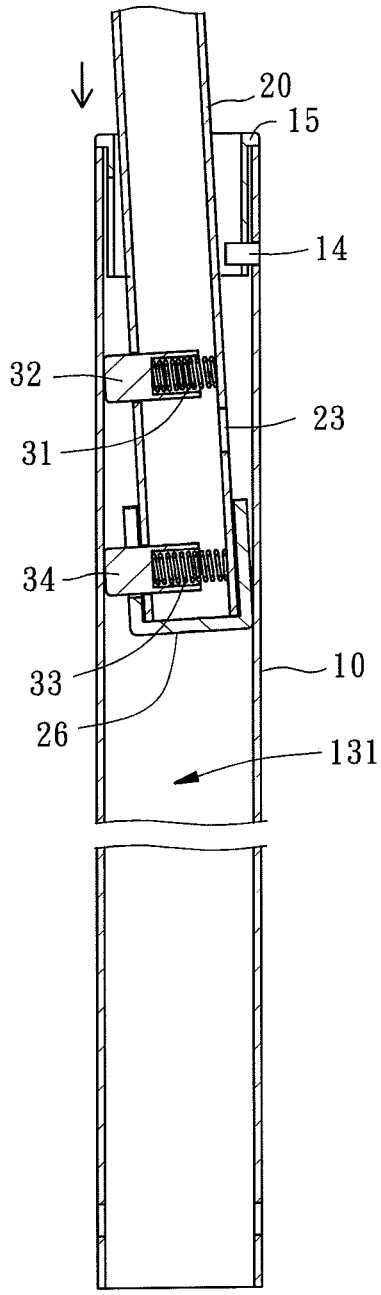
Figure 8:
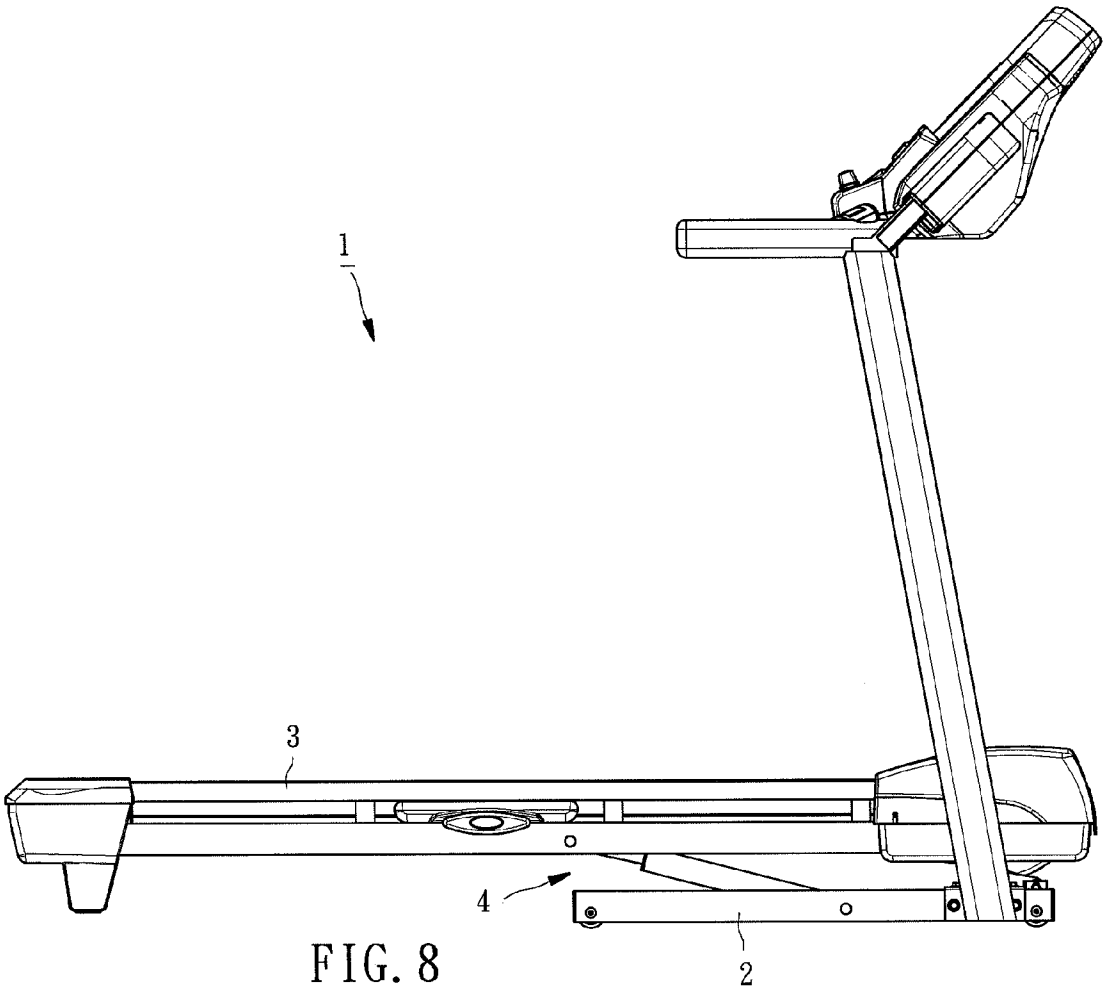
FIG. 8 is another side view of the treadmill of FIG. 1, wherein the treadbase lies on the ground.

As shown in FIGS. 2 and 6, when the inner tube 20 is inclined against the outer tube 10, the protrusion 14 is disengaged from the positioning hole 23, so that the inner tube 20 can slide within the accommodating space 131, as shown in FIG. 7, to change the length of the supporting structure 4 to the extent that the treadbase 3 lies horizontally, as shown in FIG. 8. The inner tube 20 may be inclined against the outer tube 10 by, without limitation to, having the outer tube 10 laterally kicked by a user and thereby biased.

While the inner and outer tubes 10, 20 in the present embodiment can be operated as described previously without using any pedal set at the surface of the supporting structure, a pedal for a user to pedal and thereby control the movement of the inner and outer tubes 10, 20 may be included in the present invention. In other embodiments of the present invention, the spring means may be simply composed of a coil spring, a torque spring, a reed or an elastic member made of rubber. In other embodiments of the present invention, the inner tube 20 may have the spring means directly attached to the outer wall of the inner tube 20 without having the first and second lateral holes 24, 25 formed thereon. These and other structural changes or modifications apparent to people skilled in the art which do not depart from the concept of the present invention should be encompassed by the appended claims.

What is claimed is:

1. A supporting structure for a treadmill, the treadmill including a foundation lying on the ground and a treadbase swingable with respect to the foundation, the supporting structure being such connected between the foundation and the treadbase that the supporting structure has a viable length and is selectively fixable at a predetermined length to fix an included angle between the foundation and the treadbase, and the supporting structure comprising:

an outer tube having an outer-tube pivotal end, an outer-tube telescoping end, an inner wall defining an accommodating space, and a protrusion fixed to the inner wall and jutting out into the accommodating space, wherein the outer tube at where the protrusion exists has an outer-tube internal diameter as r, and the protrusion has a free end that is apart from the inner wall by a vertical distance as L;

an inner tube having an inner-tube pivotal end, an inner-tube telescoping end, and a positioning hole for receiving the protrusion, wherein the outer-tube pivotal end and the inner-tube pivotal end are pivotally connected to the foundation and the treadbase, respectively, the inner-tube telescoping end being inserted into the accommodating space from the outer-tube telescoping end, and the inner tube at where the positioning hole exists having an inner-tube external diameter as R, wherein (R+L)<r; and a spring assembly for placing a resilient prestress on the inner tube toward the protrusion;

wherein, when the inner tube is substantially parallel to the outer tube and the protrusion faces the positioning hole, the spring assembly pushes the inner tube toward the protrusion, so as to make the protrusion enter the positioning hole, thereby fixing the supporting structure at the predetermined length, and when the inner tube is inclined with respect to the outer tube, the protrusion is disengaged from the positioning hole, so as to allow the inner tube to slide within the accommodating space, thereby varying the length of the supporting structure.

2. The supporting structure of claim 1, wherein the inner tube further comprises a first lateral hole, and the spring assembly comprises a first spring member and a first crown, the first crown being received in the first lateral hole, and the first spring member biasing between the first crown and the inner-tube inner wall for selectively propping the first crown outward the first lateral hole to abut against the inner wall of the outer tube.

3. The supporting structure of claim 2, wherein the inner tube further comprises a second lateral hole, and the spring assembly further comprises a second spring member and a second crown, the second crown being received in the second lateral hole, and the second spring member biasing between the second crown and the inner-tube inner wall for selectively propping the second crown outward the second lateral hole to abut against the inner wall of the outer tube.

4. The supporting structure of claim 3, wherein the inner tube further comprises an end cap that is attached to the inner-tube telescoping end and has a notch for receiving the second crown.

5. The supporting structure of claim 1, wherein the outer tube further comprises a shroud that is received in the outer-tube telescoping end and has a through hole for receiving the inner tube, the through hole having a length in a first direction being greater than an external diameter of the inner tube in the first direction, the through hole having a length in a second direction that is perpendicular to the first direction being equal to or slightly greater than the external diameter of the inner tube in the second direction, and the first direction being parallel to a direction in which the protrusion extends.

* * * * *